US007064262B2

(12) United States Patent
Klefenz et al.

(10) Patent No.: US 7,064,262 B2
(45) Date of Patent: Jun. 20, 2006

(54) METHOD FOR CONVERTING A MUSIC SIGNAL INTO A NOTE-BASED DESCRIPTION AND FOR REFERENCING A MUSIC SIGNAL IN A DATA BANK

(75) Inventors: Frank Klefenz, Mannheim (DE); Karlheinz Brandenburg, Erlangen (DE); Matthias Kaufmann, Ilmenau (DE)

(73) Assignee: Fraunhofer-Gesellschaft zur Förderung der angewandten Forschung e.V., Munich (DE)

( * ) Notice: Subject to any disclaimer, the term of this patent is extended or adjusted under 35 U.S.C. 154(b) by 254 days.

(21) Appl. No.: 10/473,462

(22) PCT Filed: Apr. 4, 2002

(86) PCT No.: PCT/EP02/03736

§ 371 (c)(1),
(2), (4) Date: Sep. 26, 2003

(87) PCT Pub. No.: WO02/084641

PCT Pub. Date: Oct. 24, 2002

(65) Prior Publication Data

US 2004/0060424 A1 Apr. 1, 2004

(30) Foreign Application Priority Data

Apr. 10, 2001 (DE) ..... 101 17 870

(51) Int. Cl.
*G10H 7/00* (2006.01)

(52) U.S. Cl. ..... 84/616

(58) Field of Classification Search ..... 84/616, 84/654; 700/94

See application file for complete search history.

(56) References Cited

U.S. PATENT DOCUMENTS 3,069,654 A 12/1962 Hough (Continued)

FOREIGN PATENT DOCUMENTS

DE 34 15 792 C2 5/1991
EP 0 331 107 A2 9/1989

(Continued)

OTHER PUBLICATIONS

Lindsay, Adam Taro, "Using Contour as a mid-level representation of Melody", Submitted to the Program in Media Arts and Sciences, School of Architecture and Planning on Aug. 20, 1996.

*Primary Examiner*—Jeffrey W Donels
(74) *Attorney, Agent, or Firm*—Dougherty Clements

(57) ABSTRACT

In a method for transferring a music signal into a note-based description, a frequency-time representation of the music signal is first generated, the frequency-time representation comprising coordinate tuples, a coordinate tuple including a frequency value and a time value, the time value indicating the time of occurrence of the assigned frequency in the music signal. Thereupon, a fit function will be calculated as a function of the time, the course of which is determined by the coordinate tuples of the frequency-time representation. For time-segmenting the frequency-time representation, at least two adjacent extreme values of the fit function will be determined. On the basis of the determined extreme values, a segmenting will be carried out, a segment being limited by two adjacent extreme values of the fit function, the time length of the segments indicating a time length of a note for the segment. For pitch determination, a pitch for the segment using coordinate tuples in the segment will be determined. For calculating the fit function and determining extreme values of the fit function for segmenting, no requirements are made to the music signal which is to be transferred into a note-based representation. The method is thus also suitable for continuous music signals.

32 Claims, 7 Drawing Sheets

U.S. PATENT DOCUMENTS

| | | | |
|---|---|---|---|
| 5,210,820 | A | 5/1993 | Kenyon |
| 5,874,686 | A | 2/1999 | Ghias et al. |
| 6,124,542 | A | 9/2000 | Wang |

FOREIGN PATENT DOCUMENTS

| | | | |
|---|---|---|---|
| EP | 0 944 033 | A | 9/1999 |
| WO | WO 01/04870 | A1 | 1/2001 |
| WO | WO 0169575 | A | 9/2001 |

METHOD FOR CONVERTING A MUSIC SIGNAL INTO A NOTE-BASED DESCRIPTION AND FOR REFERENCING A MUSIC SIGNAL IN A DATA BANK

FIELD OF THE INVENTION

The present invention relates to the field of processing music signals and, in particular, to translating a music signal into a note-based description.

BACKGROUND OF THE INVENTION AND PRIOR ART

Concepts by means of which songs are referenced by specifying a sequence of notes are of use for many users. Everybody is familiar with the situation when you are singing the tune of a song to yourself, but, except for the tune, you can't remember the title of the song. It would be desirable to sing a tune sequence or to perform the same with a music instrument and, by means of this information, reference this very tune sequence in a music database, provided that this tune sequence is contained in the music database.

The MIDI-format (MIDI=music interface description) is a note-based standard description of music signals. A MIDI file includes a note-based description such that the start and end of a tone and/or the start of the tone and the duration of the tone are recorded as a function of time. MIDI-files may for example be read into electronic keyboards and be replayed. Of course, there are also soundcards for replaying a MIDI-file via the loudspeakers connected to the soundcard of a computer. From this it can be seen that the conversion of a note-based description, which, in its most original form, is performed "manually" by means of an instrumentalist who plays a song recorded by means of notes using a music instrument, may just as well be carried out automatically.

The contrast, however, is much more complex. Converting a music signal, which is a tune sequence that is sung, performed with an instrument, or recorded by a loudspeaker, or which is a digitized and optionally compressed tune sequence available in the form of a file, into a note-based description in the form an MIDI-file or into conventional musical notation is connected with great restrictions.

In the doctoral thesis "Using Contour as a Mid-Level Representation of Melody" by A. Lindsay, Massachusetts Institute of Technology, September 1996, a method for converting a sung music signal into a sequence of notes is described. A song has to be performed using stop consonants, i.e. as a sequence of "da", "da", "da". Subsequently, the power distribution of the music signal generated by the singer will be viewed over time. Owing to the stop consonants, a clear power drop between the end of a tone and the start of the following tone may be recognized in a power-time diagram. On the basis of the power drops, the music signal is segmented such that a note is available in each segment. A frequency analysis provides the height of the sung tone in each segment, the sequence of frequencies also being referred to as pitch-contour line.

The method offers disadvantages in that it is restricted to sung inputs. When specifying a tune, the tune has to be sung by means of a stop consonant and a vocal part in the form of "da", "da", "da" for a segmentation of the recorded music signal to be effected. This already excludes applying the method to orchestra pieces, in which a dominant instrument plays bound notes, i.e. notes which are not separated by rests.

After a segmentation, the prior art method calculates intervals of respectively two succeeding pitch-values, i.e. pitch values, in the pitch-value sequence. This interval value will be taken as a distance measure. The resulting pitch-sequence will then be compared with reference sequences stored in a database, the minimum of a sum of squared difference amounts for all reference sequences being assumed as a solution, i.e. as a note sequence referenced in the database.

A further disadvantage of this method consists in that a pitch-tracker is used comprising octave jump errors which need to be compensated for afterwards. Further, the pitch-tracker must be fine-tuned in order to provide valid values. The method merely uses the interval distances of two succeeding pitch-values. A rough quantization of the intervals will be carried out, this rough quantization only comprising rough steps being divided up into "very large", "large", "constant". By means of this rough quantization, the absolute tone settings in Hertz will get lost, as a result of which a finer determination of the tune is no longer possible.

In order to be able to carry out a music recognition it is desirable to determine from a replayed tone sequence a note-based description, for example in the form of a MIDI-file or in the form of a conventional musical notation, each note being given by tone start, tone length, and pitch.

Furthermore, it should be considered that the tune entered is not always exact. In particular, for commercial use it should be assumed that the sung note sequence may be incomplete both with respect to the pitch and with respect to the tone rhythm and the tone sequence. If the note sequence is to be performed with an instrument, it has to be assumed that the instrument might be mistuned, tuned to a different frequency fundamental tone (for example not to the standard tone A of 440 Hz but to "A" with 435 Hz). Furthermore, the instrument may be tuned in an individual key, such as for example the B-clarinet or the Es-Saxophone. Even when performing the tune with an instrument, the tune tone sequence may also be incomplete, by leaving out tones (delete), by inserting tones (insert) or by playing different (false) tones (replace). Just as well, the tempo may be varied. Moreover, it should be considered that each instrument comprises its own tone color such that a tone performed by an instrument is a mixture of fundamental tone and other frequency shares, the so-called harmonics.

SUMMARY OF THE INVENTION

It is the object of the present invention to provide a more robust method and a more robust apparatus for transferring a music signal into a tone-based description.

In accordance with a first aspect of the invention, this object is achieved by a method for transferring a music signal into a note-based description, comprising the following steps: generating a frequency-time representation of the music signal, the frequency-time representation comprising coordinate tuples, one coordinate tuple including a frequency value and a time value, the time value indicating a time of occurrence of the assigned frequency value in the music signal; calculating a fit function as a function of time, the course of the fit function being determined by the coordinate tuples of the frequency-time representation; determining at least two adjacent extreme values of the fit function; time-segmenting the frequency-time representation on the basis of the determined extreme values, a segment being limited by two adjacent extreme values of the fit function, the time length of the segment indicating a time length of a note assigned to this segment; and determining a pitch of the note for the segment using coordinate tuples in the segment.

In accordance with a second aspect of the invention, this object is achieved by an apparatus for transferring a music signal into a note-based description, comprising: a generator for generating a frequency-time representation of the music signal, the frequency-time representation comprising coordinate tuples, a coordinate tuple including a frequency value and a time value, wherein the time value indicating a time of occurrence of the assigned frequency value in the music signal; a calculator for calculating a fit function as a function of time, a course of the fit function being determined by the coordinate tuples of the frequency-time representation; a processor for determining at least two adjacent extreme values of the fit function; a time segmentor for time-segmenting the frequency-time representation on the basis of the determined extreme values, one segment being limited by two adjacent extreme values of the fit function, the time length of the segment indicating a time length of a note assigned to this segment; and another processor for determining a pitch of the note for the segment using coordinate tuples in the segment.

A further object of the present invention consists in providing a more robust method and a more robust apparatus for referencing a music signal in a database comprising a note-based description of a plurality of database music signals.

In accordance with a third object of the invention, this object is achieved by a method for referencing a music signal in a database comprising a note-based description of a plurality of database music signals, comprising the following steps: transferring the music signal into the note-based description the step of transferring comprising the following steps: generating a frequency-time representation of the music signal, the frequency-time representation comprising coordinate tuples, one coordinate tuple including a frequency value and a time value, the time value indicating a time of occurrence of the assigned frequency value in the music signal; calculating a fit function as a function of time, a course of the fit function being determined by the coordinate tuples of the frequency-time representation; determining at least two adjacent extreme values of the fit function; time-segmenting the frequency-time representation on the basis of the determined extreme values, a segment being limited by two adjacent extreme values of the fit function, the time length of the segment indicating a time length of a note assigned to this segment; and determining a pitch of the note for the segment using coordinate tuples in the segment; comparing the note-based description of the music signal with the note-based description of the plurality of database music signals in the database; making a statement with respect to the music signal on the basis of the step of comparing.

In accordance with a fourth object of the invention, this object is achieved by an apparatus for referencing a music signal in a database, comprising a note-based description of a plurality of database music signals, comprising: means for transferring the music signal into a note-based description, the means for transferring being operative for: generating a frequency-time representation of the music signal, the frequency-time representation comprising coordinate tuples, one coordinate tuple including a frequency value and a time value, the time value indicating a time of occurrence of the assigned frequency value in the music signal; calculating a fit function as a function of time, a course of the fit function being determined by the coordinate tuples of the frequency-time representation; determining at least two adjacent extreme values of the fit function; time-segmenting the frequency-time representation on the basis of the determined extreme values, a segment being limited by two adjacent extreme values of the fit function, the time length of the segment indicating a time length of a note assigned to this segment; and determining a pitch of the note for the segment using coordinate tuples in the segment; means for comparing the note-based description of the music signal with the note-based description of the plurality of database music signals in the data bank; and means for making a statement with respect to the music signal on the basis of the step of comparing.

The present invention is based on the recognition that, for an efficient and robust transferal of a music signal into a note-based description, a restriction is not acceptable in that a note sequence sung or performed by an instrument must be performed by stop consonants resulting in that the power-time representation of the music signal comprises clear power drops which may be used to carry out a segmentation of the music signal in order to separate individual tones of the tune sequence from each other.

In accordance with the invention, a note-based description is achieved from the music signal of a note-based description, which has been sung or performed with a music instrument or is available in any other form, by first generating a frequency-time representation of the music signal, the frequency-time representation comprising coordinate tuples, one coordinate tuple comprising a frequency value and a time value, the time value specifying the time of occurrence of the assigned frequency in the music signal. Subsequently, a fit function will be calculated as a function of the time, the course of which will be determined by the coordinate tuples of the frequency-time representation. At least two adjacent extreme values will be determined from the fit function. The time segmentation of the frequency-time representation, in order to be able to differentiate between tones of a tune sequence, will be carried out on the basis of the determined extreme values, one segment being limited by the at least two adjacent extreme values of the fit functions, the time length of the segment indicating a time length of a note for the segment. A note rhythm is thus obtained. The note heights are finally determined using only coordinate tuples in each segment, such that, for each segment, a tone is determined, the tones in the succeeding segments indicating the tune sequence.

An advantage of the present invention consists in that a segmentation of the music signal is achieved independent of whether the music signal is performed by an instrument or by singing. In accordance with the invention it is no longer necessary that a music signal to be processed has a power-time course, which has to comprise clear drops in order to be able to effect segmentation. With the inventive method, the type of entering a tune is thus no longer restricted to a particular type. While the inventive method works best with monophonic music signals as are generated by a single voice or by a single instrument, it is also suitable for a polyphonic performance, provided an instrument and/or a voice is predominate in the polyphonic performance.

On the basis of the fact, that the time-segmentation of the note of the tune sequence representing the music signal is no longer carried out by power considerations, but by calculating a fit function using a frequency-time representation, it is possible to make a continuous entry which most likely corresponds to natural singing or natural instrument performance.

In a preferred embodiment of the present invention, an instrument-specific postprocessing of the frequency-time representation is carried out in order to post-process the frequency-time representation by knowing the characteristics of a certain instrument to achieve a more exact pitch-contour line and thus a more precise pitch determination.

An advantage of the present invention consists in that the music signal may be performed by any harmonic-sustained music instrument, these harmonic-sustained music instruments including brass instruments, wood wind instruments or even stringed instruments, such as plucked instruments, stringed instruments or percussion instruments. From the frequency-time distribution, independent of the tone color of the instrument, the fundamental tone performed will be extracted, which is specified by a note of a musical notation.

Thus, the inventive concept distinguishes itself by providing the option that the tune sequence, i.e. the music signal, may be performed by any music instrument. The inventive concept is robust towards mistuned instruments, wrong pitches, when untrained singers sing or whistle a tune or in the case of differently performed tempi in the song piece to be processed.

Furthermore, in its preferred implementation, in which a Hough transform is used for generating the frequency-time representation of the music signal, the method may be implemented in an efficient manner in terms of calculating time, thus achieving a high performance speed.

A further advantage of the inventive concept consists in that, for referencing a music signal sung or performed by an instrument, on the basis of the fact that a note-based description providing a rhythm-representation and a representation of the note heights, a referencing may be carried out in a database, in which a multitude of music signals have been stored. In particular, on the basis of the great circulation of the MIDI-standard, there exists a wealth of MIDI-files for a great number of music pieces.

A further advantage of the inventive concept consists in that, on the basis of the generated note-based description, using the methods of the DNA sequencing, it is possible to search music databases, for example in the MIDI-format, with powerful DNA sequencing algorithms, such as, for example, the Boyer-Moore algorithm, using replace/insert/delete operations. This type of a time-sequential comparison using a simultaneously controlled manipulation of the music signal further provides the required robustness against imprecise music signals as may be generated by untrained instrumentalists or untrained singers. This point is essential for a high degree of circulation of a music recognition system, since the number of trained instrumentalists and trained singers is rather small in our population.

BRIEF DESCRIPTION OF THE DRAWINGS

Preferred embodiments of the present invention will be explained below in detail with reference to the attached drawings, in which.

DETAILED DESCRIPTION OF PREFERRED EMBODIMENTS

Figure 1:
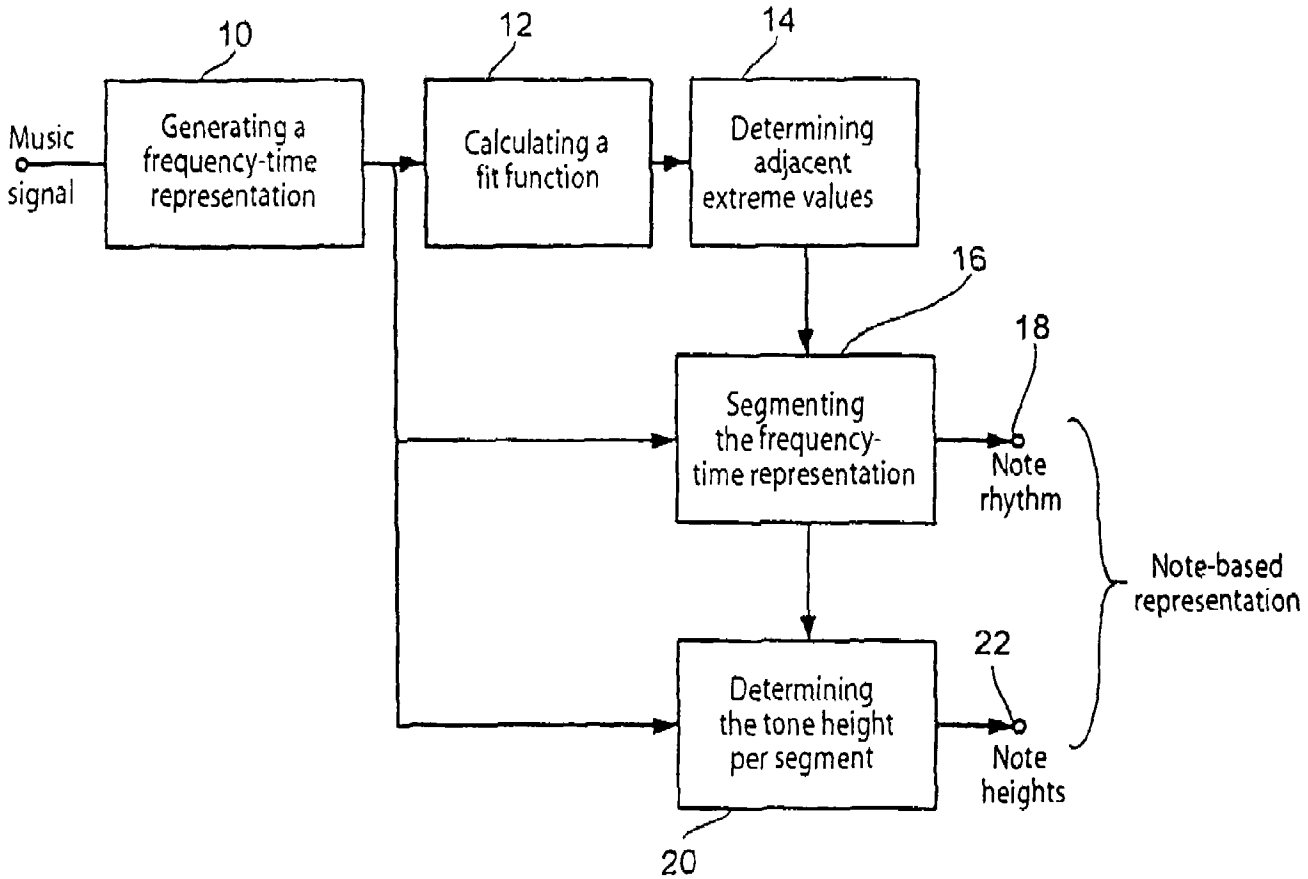
FIG. 1 shows a block diagram of an inventive apparatus for transferring a music signal into a note-based representation.

FIG. 1 shows a block diagram of an inventive apparatus for transferring a music signal in a note-based representation. A music signal, which is available in a sung form, instrumentally performed form or in the form of digital time sampled values, is fed into a means 10 for generating a frequency-time representation of the music signal, the frequency-time representation comprising coordinate tuples, a coordinate tuple including a frequency value and a time value, the time value indicating the time of occurrence of the assigned frequency in the music signal. The frequency-time representation is fed into a means 12 for calculating a fit function as a function of the time, the course of which is determined by the coordinate tuple of the frequency-time representation. From the fit function, adjacent extremes are determined by means of a means 14, which will then be used by a means 16 for segmenting the frequency-time representation in order to carry out a segmentation indicating a note rhythm, which will be output to an output 18. The segmenting information will be further used by a means 20, which is provided for determining the pitch per segment. For determining the pitch per segment, means 20 uses only the coordinate tuples in a segment in order to output, for the succeeding segments, succeeding pitches to an output 22. The data at the output 18, that is the rhythm information, and the data at the output 22, that is the tone and/or note height information, together form a note-based representation from which an MIDI-file, or, by means of a graphic interface, also a musical notation may be generated.

In the following, a preferred implementation for generating a frequency-time representation of the music signal will be elaborated upon by means of FIG. 2. A music signal, which is for example available as a sequence of PCM samples as are generated by recording a sung or instrumentally performed music signal and subsequent sampling and A/D-converting, will be fed into an audio I/O handler 10*a*. Alternatively, the music signal available in a digital format may also come directly from the hard disk of a computer or from the soundcard of a computer. As soon as the I/O handler 10*a* recognizes an end-of-file mark, it closes the audio file and, as required, loads the next audio file to be processed or terminates the read-in operation. The PCM samples (PCM=pulse code modulation), which are available in the form of an electric current, will be conveyed one after the other to a preprocessing means 10*b*, in which the data stream is converted to a uniform sample rate. It is preferred to be capable of processing several sample rates, wherein the sample rate of the signal should be known to determine parameters for the following signal edge detection unit 10*c* from the sample rate.

The preprocessing means 10*b* further includes a level matching unit which generally carries out a standardization of the sound volume of the music signal, since the sound volume information of the music signal is not required in the frequency-time representation. For the sound volume information not to influence the determination of the frequency-time coordinate tuples, a sound volume standardization will be effected as follows. The preprocessing unit for standardizing the level of the music signal includes a look-ahead buffer and determines from the same the medium sound volume of the signal. The signal will then be multiplied by a scaling factor. The scaling factor is the product from a weighting factor and the quotient from a full-scale deflection and medium signal sound volume. The length of the look-ahead buffer is variable.

The edge detection means 10*c* is arranged to extract, from the music signal, signal edges of a specified length. The means 10*c* preferably carries out a Hough transform.

The Hough transform is described in the U.S. Pat. No. 3,069,654 by Paul V. C. Hough. The Hough transform serves for recognizing complex structures and, in particular, for automatically recognizing complex lines in photographs or other image representations. In its application in accordance with the present invention, the Hough transform is used for extracting, from the time signal, signal edges with specified time lengths. A signal edge is first specified by its time length. In the ideal case of a sinus wave, a signal edge would be defined by the rising edge of the sinus function from 0 to 90°. Alternatively, the signal edge might also be specified by the rising of the sinus function from −90° to +90°.

If the time signal is available as a result of sampled time values, the time length of a signal edge, considering the sampling frequency with which the sample have been generated, corresponds to a certain number of sampled values. The length of a signal edge may thus be easily specified by specifying the number of sampled values, which the signal edge is to include.

Moreover, it is preferred to detect a signal edge only then as a signal edge if the same is steady and comprises a monotonous waveform, i. e. comprises a monotonously rising waveform in the case of a positive signal edge. Of course, negative signal edges, i. e. monotonously falling signal edges, may be detected as well.

A further criterion for classifying signal edges consists in detecting a signal edge only then as a signal edge, if it sweeps a certain level range. In order to reject any noise disturbances, it is preferred to output a minimum level range or amplitude range for a signal edge, monotonously rising signal edges below this range not being detected as signal edges.

The signal edge detection unit 12 thus provides a signal edge and the time of occurrence of the signal edge. In this case it is not important, whether the time of the first sampled value of the signal edge, the time of the last sampled value of the signal edge or the time of any sampled value within the signal edge is taken as time of the signal edge, as long as succeeding signal edges are treated equally.

A frequency calculating unit 10*d* is installed after the edge detector 10*c*. The frequency calculating unit 10*d* is implemented to search for two signal edges, which are succeeding one another in time and which are equal or equal within a tolerance value, and then to form the difference of the occurrence times of the signal edges. The inverse value of the difference corresponds to the frequency which is determined by the two signal edges. If a simple sinus tone is considered, a period of the sinus tone is given by the time distance of two succeeding, for example, positive signal edges of equal length.

Figure 8:
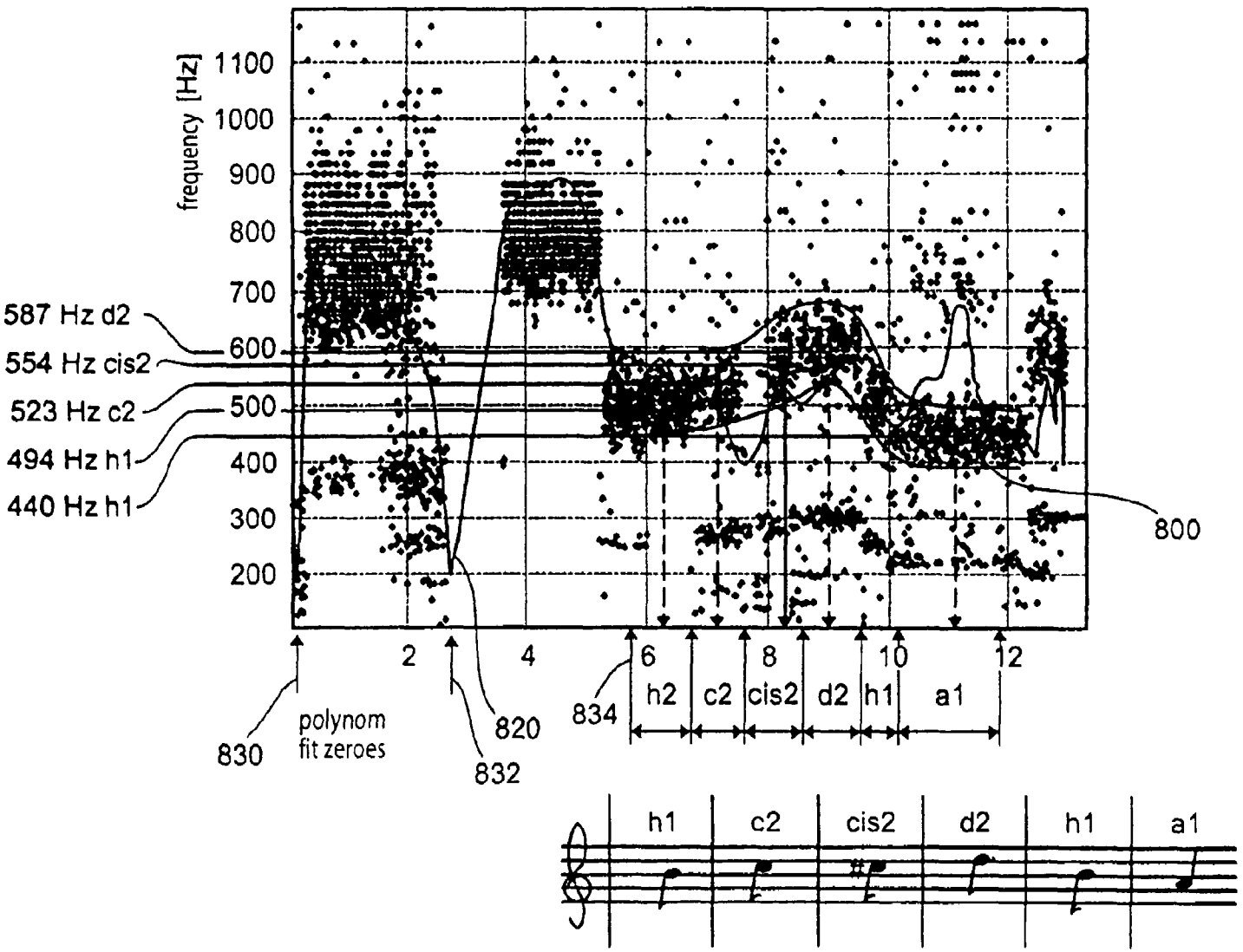
FIG. 8 shows a frequency-time diagram of the first 13 seconds of the clarinet quintet in A major by W. A. Mozart, K 581, Larghetto, Jack Bryner, clarinet, recording: December 1969, London, Philips 420 710-2 including fit function and note heights.

It should be appreciated, that the Hough transform comprises a high resolution when detecting signal edges in the music signal such that, by means of the frequency calculating unit 10*d*, a frequency-time representation of the music signal may be obtained, which comprises the frequencies available at a certain point of time with a high resolution. Such a frequency-time representation is shown in FIG. 8. The frequency-time representation has a time axis as an abscissa, along which the absolute time is plotted in seconds, and also has as an ordinate a frequency axis, in which the frequency is plotted in Hertz in the representation selected in FIG. 8. All image points in FIG. 8 represent time-frequency coordinate tuples as they are obtained, if the first 13 seconds of the work by W. A. Mozart, Köchel No. 581, is subjected to a Hough transform. In about the first 5.5 seconds of this piece, there is a relatively polyphonic orchestra part with a great bandwidth of relatively regularly occurring frequencies between about 600 and about 950 Hz. Then, approximately after 5.5 seconds, a dominant clarinet voice comes in, which plays the tone sequence H1, C2, Cis2, D2, H1 and A1. As against the clarinet, the orchestra music recedes to the background, which, in the frequency-time representation from FIG. 8, becomes apparent in that the principal distribution of the frequency-time coordinate tuples ranges within a limited band 800, which is also referred to as a pitch-contour strip band. An accumulation of coordinate tuples around a frequency value suggests that the music signal has a relative monophonic share, wherein it is to be noted that common brass/wood wind instruments, apart from the fundamental tone, generate a multitude of harmonics, such as for example the octave, the next quint, etc. These harmonics, too, are determined by means of the Hough transform and a subsequent frequency calculation by the unit 10*d* and contribute to the widened pitch-contour strip band. Also the vibrato of a music instrument, which is characterized by a fast frequency change over time of the tone played, contributes to a widening of the pitch-contour strip band. If a sequence of sinus tones is generated, the pitch-contour strip band would degenerate to a pitch-contour line.

A means 10*e* for determining accumulation ranges is installed after the frequency calculating unit 10*d*. In the means 10*e* for determining the accumulation ranges, the characteristic clusters resulting as a stationary feature when processing audio files are worked out. For this purpose, an elimination of all isolated frequency-time tuples, which exceed a specified minimum distance to the next spatial neighbor, may be carried out. Thus, such a processing will result in that almost all coordinate tuples above the pitch-contour strip band 800 are eliminated, as a result of which, with reference to the example of FIG. 8, only the pitch-contour strip band and some accumulation ranges below the pitch-contour strip band remain in the range from 6 to 12 seconds.

The pitch-contour strip band 800 thus consists of clusters of a certain frequency width and time length, these clusters being induced by the tones played.

Figure 3:
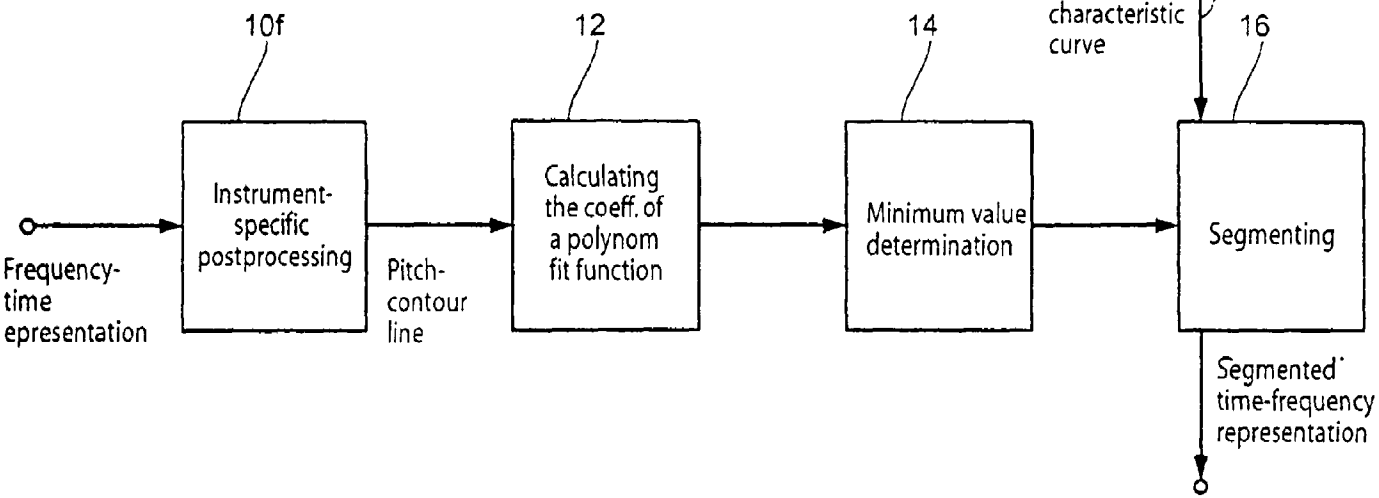
FIG. 3 shows a block diagram of a preferred apparatus for generating a segmented time-frequency representation from the frequency-time representation provided by FIG. 2.

The frequency-time representation generated by the means 10*e* in which the isolated coordinate tuples have already been eliminated will preferably be used for further processing using the apparatus shown in FIG. 3. Alternatively, the elimination of tuples outside the pitch-contour strip band, however, might be dispensed with in order to reach a segmenting of the time-frequency representation.

This, however, might result in that the fit function to be calculated is "misled" and provides extreme values which are not assigned to any tone limits, but which are available on the basis of the coordinate tuples ranging outside the pitch-contour strip band.

In a preferred embodiment of the present invention, as is shown in FIG. 3, an instrument-specific postprocessing 10*f* is carried out to possibly generate one single pitch-contour line from the pitch-contour strip band 800. For this purpose, the pitch-contour strip band is subjected to an instrument-specific case analysis. Certain instruments, such as, for example, the oboe or the French horn, comprise characteristic pitch-contour strip bands. In the case of the oboe, for example, two parallel strip bands occur, since, owing to the double-read of the oboe mouthpiece, the air column is induced to generate two longitudinal oscillations of different frequency, and the oscillation mode oscillates between these two modes. The means 10*f* for an instrument-specific postprocessing examines the frequency-time representation for any characteristic features and, if these features have been identified, it turns on an instrument-specific postprocessing method, which, for example, makes detailed reference to specialities of various instruments stored in a database. For example, one possibility would be to either take the upper one or the lower one from the two parallel strip bands of the oboe or take a mean value or median value between both strip bands as a basis for further processing as required. In principle, it is possible to identify individual characteristics in the frequency-time diagram for individual instruments, since each instrument comprises a typical tone color, which is determined by the composition of the harmonics and the time course of the fundamental frequency and the harmonics.

Ideally, at the output of the means 10*f*, a pitch-contour line, i. e. a very narrow pitch-contour strip band is obtained. In the case of a polyphonic sound mixture with a dominant monophonic voice, such as for example the clarinet voice in the right half of FIG. 8, no pitch-contour line is achievable, despite of an instrument-specific postprocessing, since also the background instruments play tones leading to widening.

However, in the case of a monophonic singing voice or an individual instrument without background orchestra, a narrow pitch-contour line is available after the instrument-specific postprocessing by means 10*f*.

Figure 2:
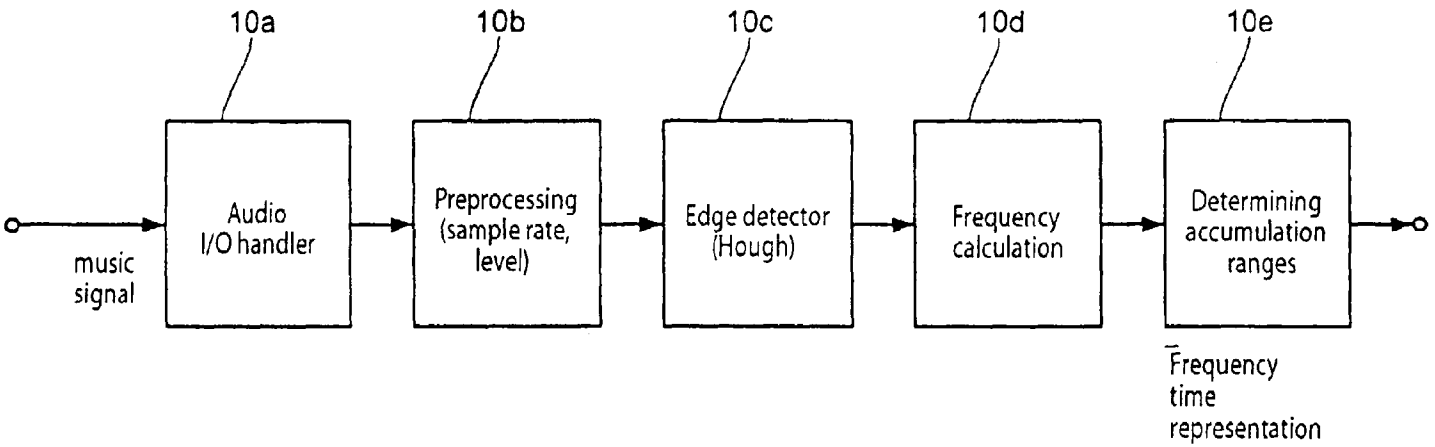
FIG. 2 shows a block diagram of a preferred apparatus for generating a frequency-time representation from a music signal, in which a Hough transform is employed for edge detections.

Here, it should be appreciated, that the frequency-time representation, as is for example available behind the unit 10 from FIG. 2, may alternatively also be generated by a frequency transformation method as is, for example, a fast Fourier transformation. By means of a Fourier transformation, a short-term spectrum is generated from a block of sampled time values of the music signal. One problematic aspect in the Fourier transformation, however, is the fact of the low time resolution, if a block with many sampled values is transformed into the frequency range. However, a block having many sampled values is necessary to achieve a good frequency resolution. If, in contrast, in order to achieve a good time resolution, a block having few sampled values is used, a lower frequency resolution will be achieved. From this it can be seen that, in a Fourier transformation, either a high frequency resolution or a high time resolution may be achieved. A high frequency resolution and a high time resolution exclude each other, if the Fourier transformation is used. If in contrast, an edge detection by means of the Hough transform and a frequency calculation is carried out to obtain the frequency-time representation, both a high frequency resolution and a high time resolution may be achieved. In order to be able to determine a frequency value, the procedure with the Hough transform merely requires, for example, two rising signal edges, and thus, only two period durations. In contrast to the Fourier transformation, however, the frequency having a low resolution is determined, while, at the same time, a high time resolution is achieved. For this reason, the Hough transform for generating the frequency-time representation is preferred against a Fourier transformation.

In order to determine a pitch of a tone, on the one hand, and to be able to determine the rhythm of a music signal, on the other, it must be determined from the pitch-contour line when a tone starts and when the same ends. For this purpose, a fit function is used in accordance with the invention, wherein, in a preferred embodiment of the present invention, a polynomial fit function having a degree n is used.

While, for example, other fit functions on the basis of sinus functions or exponentiation functions are possible, a polynomial fit function having a degree n is preferred in accordance with the present invention. If a polynomial fit function is used, the distances between to minimum values of the polynomial fit function give an indication as to the time segmentation of the music signal, i.e. to the sequence of notes of the music signal. Such a polynomial fit function 820 is plotted in FIG. 8. It can be seen that, at the beginning and after about 2.8 seconds, the polynomial fit function 820 comprises two polynomial fit zeros 830, 832, which "introduce" the two polyphonic accumulation ranges at the beginning of the Mozart piece. Then, the Mozart piece merges into a monophonic figure, since the clarinet emerges in a dominant way as against the accompanying string players and plays the tone sequence h1 (quaver), c2 (quaver), cis2 (quaver), d2 (dotted quaver), h1 (semiquaver), and a1 (crochet). Along the time axis, the minimum values of the polynomial fit function are marked by the small arrows (for example 834). While, in a preferred embodiment of the present invention, it is preferred not to immediately use the time occurrence of the minimum values for segmentation, but to still carry out a scaling with a previously calculated scaling characteristic curve, a segmentation without using the scaling characteristic curve already results in useable results, as can be seen from FIG. 8.

The coefficients of the polynomial fit function, which may comprise a high degree in the range of over 30, will be calculated using methods of compensation calculation using the frequency-time coordinate tuples, which are shown in FIG. 8. In the example shown in FIG. 8, all coordinate tuples are used for this purpose. The polynomial fit function is thus put into the frequency-time representation so that the polynomial fit function is optimally put into the coordinate tuples in a certain section of the piece, in FIG. 8 the first 13 seconds, such that the distance of the tuples to the polynomial fit function, in an overall calculation, becomes a minimum. As a result, "fake minimum values" may be generated, such as for example the minimum values of the polynomial fit function at about 10.6 seconds. This minimum values comes from the fact that, below the pitch-contour strip band, there are clusters, which are preferredly removed by the means 10*e* for determining the accumulation ranges (FIG. 2).

After the coefficients of the polynomial fit function have been calculated, the minimum values of the polynomial fit function may be determined by means of a means 10*h*. Since the polynomial fit function is available in analytical form, it is easily possible to effect a simple derivation and zero point search. For other polynomial fit functions, numerical methods for derivation and searching for zero points may be employed.

As has already been explained, a segmenting of the time-frequency representation will be carried out by the means 16 on the basis of the determined minimum values.

In the following, reference will be made as to how the degree of the polynomial fit function, the coefficients of which are calculated by the means 12, are determined in accordance with a preferred embodiment. For this purpose, a standard tone sequence having fixed standard lengths for calibrating the inventive apparatus is replayed. Thereupon, a coefficient calculation and minimum value determination is carried out for the polynomials of varying degrees. The degree will then be selected such that the sum of the differences of two succeeding minimum values of the polynomial from the measured tone length, i.e. by segmenting certain tone lengths, of the played standard reference tones is minimized. Too low a degree of the polynomial results in that the polynomial acts to harsh and cannot follow the individual tones, while too high a degree of the polynomial may result in that the polynomial fit function "fidgets" too much. In the example shown in FIG. 8 a fiftieth order polynomial was selected. This polynomial fit function will then be taken as a basis for a succeeding operation such that the means for calculating the fit function (12 in FIG. 1) preferredly has to calculate only the coefficients of the polynomial fit function and not additionally the degree of the polynomial fit function in order to achieve a calculating time saving.

The calibration course using the tone sequence from standard reference tones of specified length may be further used to determine a scaling characteristic curve which may be fed into the means 16 for segmenting (30) to scale the time distance of the minimum values of the polynomial fit function. As can be seen from FIG. 8, the minimum values of the polynomial fit function does not lie immediately at the beginning of the pile representing the tone h1, i. e. not immediately at about 5.5 seconds, but at about 5.8 seconds. If a higher order polynomial fit function is selected, the minimum values would be moved rather to the edge of the pile. This, however, might result in that the polynomial fit function fidgets too much and generates too many fake minimum values. Therefore, it is preferred to generate the scaling characteristic curve, which has a scaling factor ready for each calculated minimum value distance. Depending on the quantization of the standard reference tones played, a scaling characteristic curve with a freely selectable resolution may be generated. It should be appreciated, that this calibration and/or scaling characteristic curve has to be generated only once before taking the apparatus into operation in order to be able to be used during an operation of the apparatus for transferring a music signal into a note-based description.

The time segmentation of the means 16 is thus effected by the nth order polynomial fit, the degree being selected such prior to taking the apparatus into operation that the sum of the differences of two succeeding minimum value of the polynomial from the measured tone lengths from standard reference tones is minimized. From the medium division, the scaling characteristic curve is determined, which makes the reference between the tone length measured with the inventive method and the actual tone length. While useful results are already obtained without scaling, as is made clear in FIG. 8, the accuracy of the method may still be improved by the scaling characteristic curve.

Figure 4:
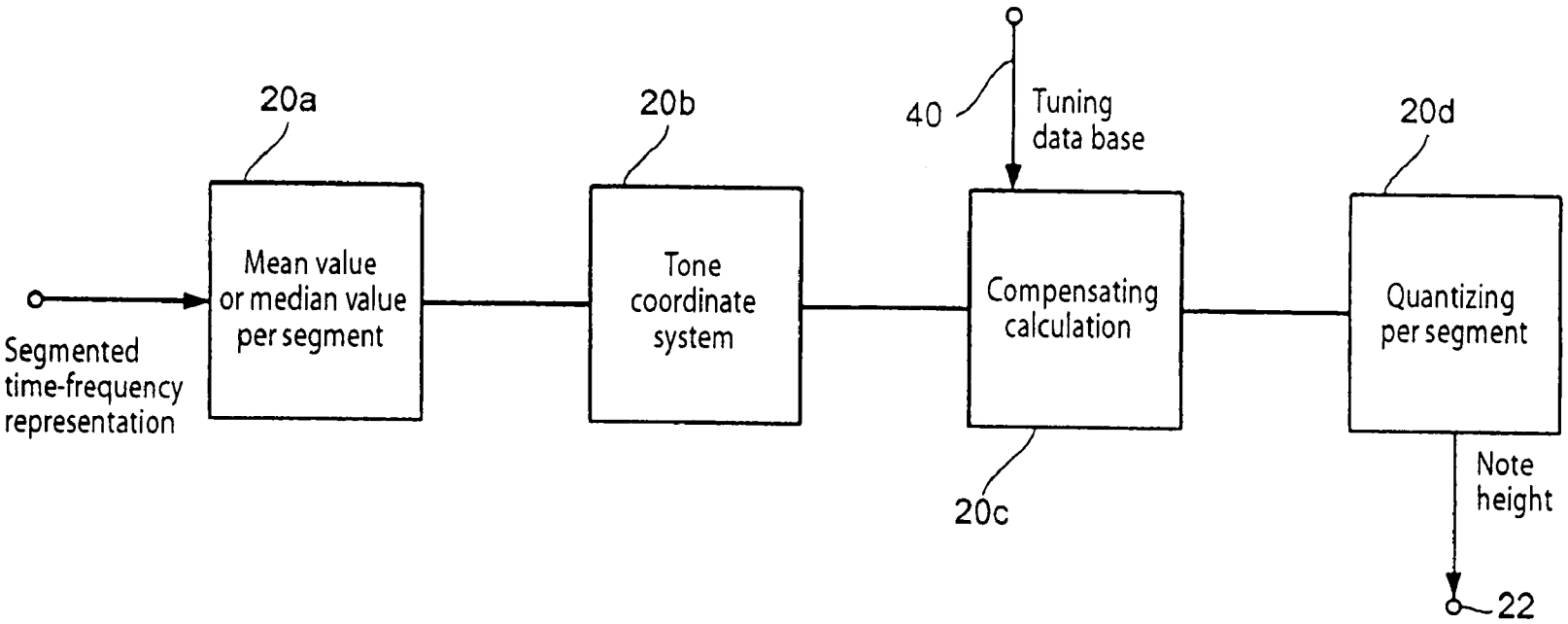
FIG. 4 shows an inventive apparatus for determining a sequence of note heights on the basis of the segmented time-frequency representation determined from FIG. 3.

In the following, reference is made to FIG. 4, in order to represent a preferred structure of the means 20 for determining the pitch per segment. The time-frequency representation segmented by the means 16 from FIG. 3 is fed into a means 20*a* to form a mean value of all frequency tuples or a median value of all coordinate tuples per segment. The best results are obtained if only the coordinate tuples within the pitch-contour line are used. In the means 20*a*, a pitch value, i.e. a pitch value, is thus formed for each cluster, the interval limits of which have been determined by the means 16 for segmenting (FIG. 3). The music signal is thus already available at the output of the means 20*a* as a sequence of absolute pitch heights. In principle, this sequence of absolute pitch heights might already be used as a note sequence and/or note-based representation.

In order to obtain a more robust note calculation, and in order to become independent from the tuning of the various instruments etc., the absolute tuning, which is specified by indicating the frequency relationships of two adjacent half-tone stages and the reference standard tone, will be determined by using the sequence of pitch values at the output of the means 20*a*. For this purpose, a tone coordinate system will be calculated from the absolute pitch values of the tone sequence by the means 20*b*. All tones of the music signal will be taken, and all tones from the other tones are subtracted each in order to obtain possibly all half-tones of the musical scale based on the music signal. For example, the interval combination pairs for a note sequence of the length are: note 1 minus note 2, note 1 minus note 3, note 1 minus note 4, note 1 minus note 5, note 2 minus note 3, note 2 minus note 4, note 2 minus note 5, note 3 minus note 4, note 3 minus note 5, note 4 minus note 5.

The set of interval values forms a tone coordinate system. The same will now be fed into the means 20*c* which carries out a compensation calculation and which compares the tone coordinate system calculated by the means 20*b* with tone coordinate systems which are stored in a database 40 of tunings. The tuning may be equal (division of an octave in 12 equally large half-tone intervals), enharmonic, naturally harmonic, pythagoraeic, middletone, in accordance with Huygens, twelve-part with a natural harmonic basis in accordance with Kepler, Euler, Mattheson, Kirnberger I+II, Malcolm, with modified quints in accordance with Silbermann, Werckmeister III, IV; V, VI, Neidhardt I, II, III. The tuning may just as well be instrument-specific, caused by the structure of the instrument, i.e. for example by the arrangement of the flaps and keys etc. By means of the methods of the compensational calculation, the means 20*c* determines the absolute half-tone stages by assuming the tuning by means of variation calculation which minimizes the total sum of the residues of the distances of the half-tone stages from the pitch values. The absolute tone stages are determined by changing the half-tone stages in parallel in steps from 1 Hz and taking those half-tone stages as absolute which minimize the total sum of the residues of the distances of the half-tone stages from the pitch values. For each pitch value a deviation value from the next half-tone stage results. As a result of this, extremely differing values may be determined, it being possible to exclude these values by iteratively recalculating the tuning without these differing values. At the output of the means 20*c*, a segment of a next half-tone stage of the tuning underlying the music signal is available for each pitch value. By means of a means 20*d* for quantizing, the pitch value will be replaced by the next half-tone stage such that at the output of the means 20*d* a sequence of note heights in addition to information on the tuning underlying the music signal, and the reference standard tone are available. This information at the output of the means 20*c* could now be easily used for generating a musical notation or for writing an MIDI-file.

It should be appreciated that the quantizing means 20*d* is preferred to become independent of the instrument, which the musical signal delivers. As will be illustrated in the following by means of FIG. 7, the means 20*d* is further preferably implemented not to only output the absolute quantized pitch values, but also to determine the interval half-tone jumps of two succeeding notes and to use this sequence of half-tone jumps then as a search sequence for DNA sequencer described with reference to FIG. 7. Since the music signal performed by an instrument or sung by a singer may be transported into a different tone type, depending on the basic tuning of the instrument (e.g. B-clarinet, Es-saxophone), it is not the sequence of absolute pitches that is used for the referencing described with reference to FIG. 7, but the sequence of differences, since the difference frequencies are dependent on the absolute pitch.

Figure 5:
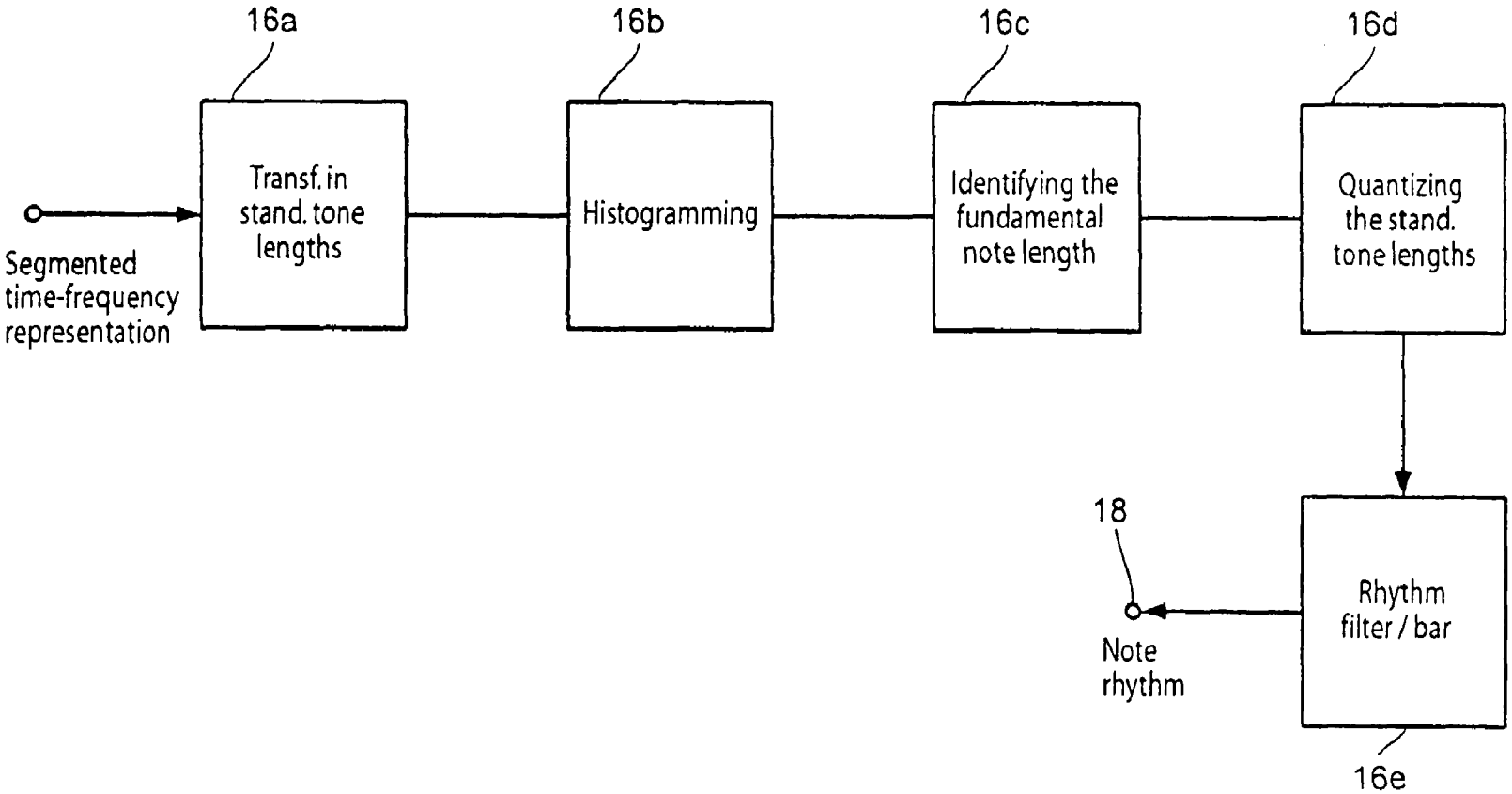
FIG. 5 shows a preferred apparatus for determining a note-rhythm on the basis of the segmented time-frequency representation from FIG. 3.
Figure 6:
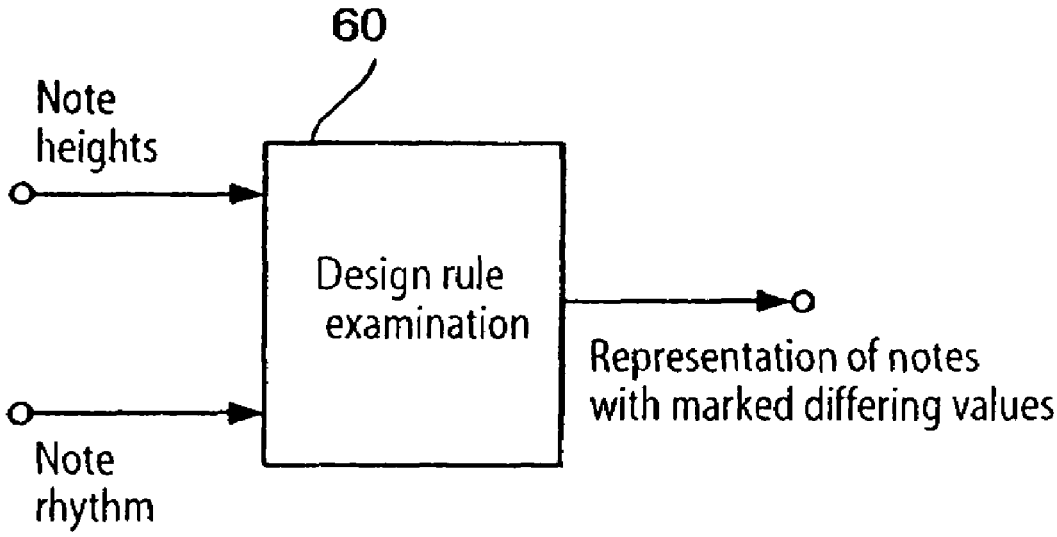
FIG. 6 shows a schematic representation of a design-rule examining means in order to check, by knowing the note heights and the note rhythm, whether the determined values make sense with respect to compositional rules.

By means of FIG. 5, the following refers to a preferred implementation of the means 16 for segmenting the frequency-time representation to generate the note rhythm. Thus, the segmenting information might already be used as rhythm information, since the duration of a tone is given by the same. However, it is preferred to transform the segmented time-frequency representation and/or the tone lengths determined from the same by the distance of two adjacent minimum value by means of means 16*a* into standardized tone lengths. This standardization will be calculated by means of a subjective-duration characteristic curve from the tone length. Thus, psychoacoustic research has shown that, for example, a ⅛ rest takes longer than a ⅛ note. Such information enter the subjective-duration characteristic curve to obtain the standardized tone lengths and thus also the standardized rests. The standardized tone length will then be fed into a means 16*b* for histogramming. The means 16*b* provides statistics about which tone lengths occur and/or around which tone lengths accumulations take place. On the basis of the tone length histogram, a fundamental note length is identified by a means 16*d* by effecting the division of the fundamental tone lengths such that the note length may be specified as an integer multiple of this fundamental note length. Thus, it is possible to obtain semiquavers, quaver crochets, half or full notes. The means 16 is based on the fact that, in usual music signals, it is not at all common to specify any tone lengths, but that the tone lengths used are usually in a fixed relationship to each other.

After the fundamental note length has been identified and thus the time length of semiquaver, quaver, crochets, half tone or full notes, the standardized tone lengths calculated by the means 16*a* are quantized in a means 16*d* in that each standardized tone length will be replaced by the next tone length determined by the fundamental tone length. Thus, a sequence of quantized standardized tone lengths is available which are preferably fed into a rhythm-fitter/bar module 16*e*. The rhythm-fitter determines the bar type by calculating if several notes taken together each form groups of three fourths notes, etc. A bar type will be assumed as a bar type in which a maximum of correct entries is available which has been standardized over the number of notes.

Thus, note height information and note rhythm information are available at the outputs 22 (FIG. 4) and 18 (FIG. 5). This information may then be merged in a means 60 for design rule examination. The means 60 examine whether the played tone sequences are structured in accordance with compositional rules of tune guidance. Notes in the sequence, which do not fit into the scheme, will be marked, for these marked notes in the DNA sequencer, which is represented by means of FIG. 7, to be treated separately. The means 16 searches for meaningful creations and is implemented to recognize, for example, whether certain note sequences cannot be played and/or do not occur.

Figure 7:
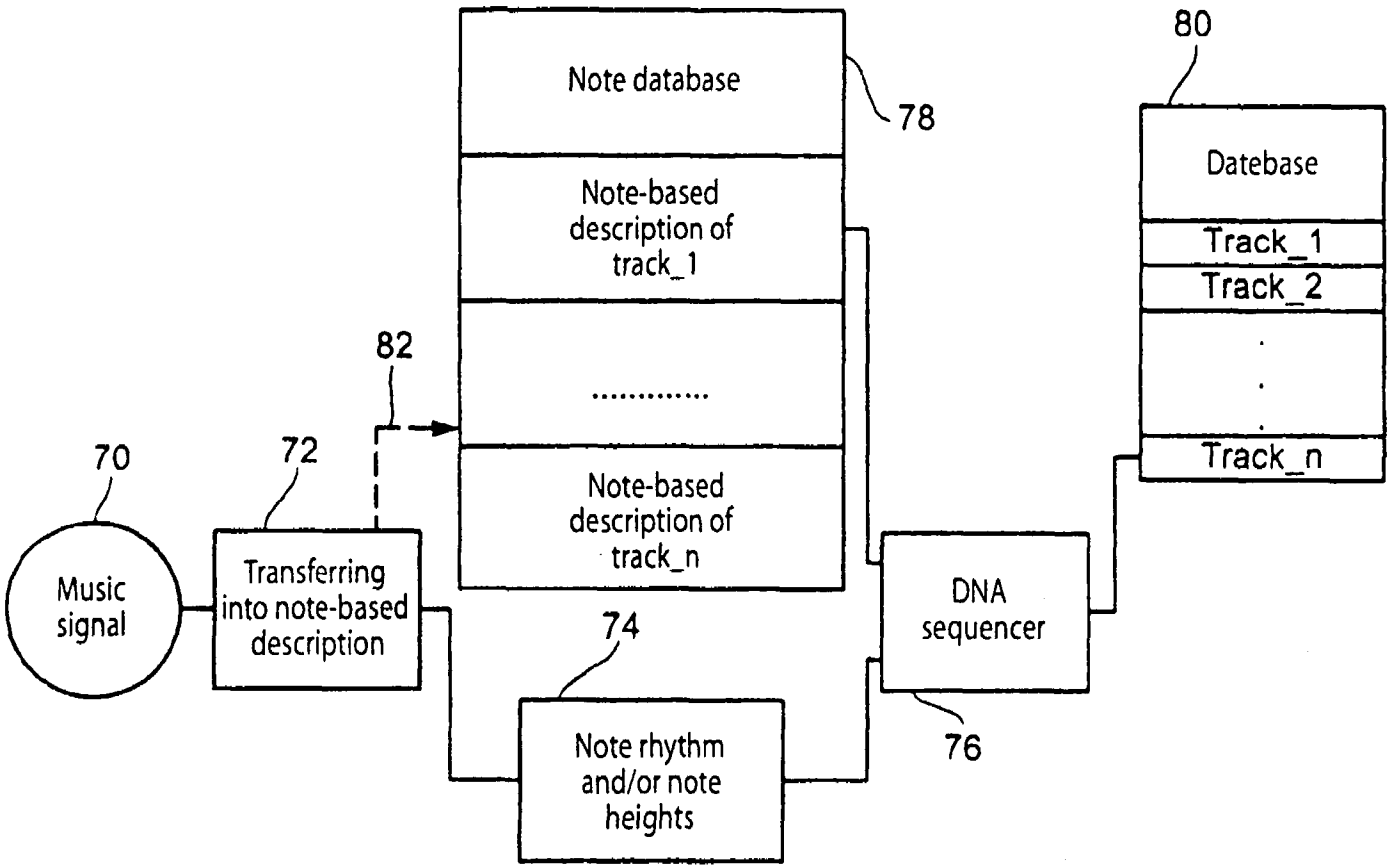
FIG. 7 shows a block diagram of an inventive apparatus for referencing a music signal in a database.

The following refers to FIG. 7 in order to represent a method for referencing a music signal in a database in accordance with a further aspect of the present invention. The music signal is available at the input, for example, as a file 70. By means of a means 72 for transferring the music signal in a note-based description, which is inventively structured in accordance with FIG. 1 to 6, note rhythm information and/or note height information are generated, which form a search sequence 74 for a DNA sequencer 76. The sequence of notes, which is represented by the search sequence 74, will now be compared either with respect to the note rhythm and/or with respect to the note heights with a multitude of note-based descriptions for various pieces (track_1 to track_n), which may be stored in a note database 78. The DNA sequencer, which represents a means for comparing the music signal with the note-based description of the database 78, examines any matching and/or similarity. Thus, a statement may be made with respect to the music signal on the basis of the comparison. The DNA sequencer 76 is preferably connected to a music database, in which the varying pieces (track_1 to track_n), the note-based description of which are stored in the note database, are deposited as an audio file. Of course, the note database 78 and the database 80 may be one single database. Alternatively, the database 80 might also be dispensed with, if the note database includes meta information over those pieces, the note-based descriptions of which are stored, such as, for example, author, name of the piece, music publishing house, imprint etc.

Generally, by means of the apparatus shown in FIG. 7, a referencing of a song is achieved, in which an audio file section, in which a tone sequence sung by a person or performed by a music instrument is recorded, is transferred into a sequence of notes, this sequence of notes being compared as a search criterion with stored note sequences in the note database, and the song from the note database being referenced, in which the greatest matching between note entry sequence and note sequence in the database is available. As a note-based description, the MIDI description is preferred, since MIDI-files already exist for great amounts of music pieces. Alternatively, the apparatus shown in FIG. 7 might also be structured to generate the note-based description itself, if the database is first operated in a learning mode, which is indicated by a dotted arrow 82. In the learning mode 82, the means 72 would at first generate a note-based description for a multitude of music signals and store the same in the note database 78. Not before the note database has been sufficiently filled, the connection 82 would be interrupted to carry out a referencing of a music signal. After the MIDI-files are already available for many pieces, it is preferred, however, to resort to the already available note databases.

In particular, the DNA sequencer 76 searches for the most similar tune tone sequence in the note database by varying the tune tone sequence by the operations replace/insert/delete. Each elementary operation is linked with a cost measure. An optimum situation would be if all notes match each other without special operations. In contrast, it would sub-optimum if n from m values would match. As a result of this, a ranking of the tune sequences would be introduced so to say, and the similarity of the music signal 70 to a database music signal track_1 . . . track_n may be indicated in a quantitative manner. It is preferred to pass the similarity of for example the best candidates from the note database as a descending list.

In the rhythm database, the notes will be deposited as semiquaver, quaver, crochet, half and full tone. The DNA sequencer searches for the most similar rhythm sequence in the rhythm database by varying the rhythm sequence by the operations replace/insert/delete. Each elementary operation is also again linked with a certain cost measure. An optimum situation would be if all note lengths would match; a sub-optimum situation would be, if n from m values would match. As a result of this, a ranking of the rhythm sequences will be introduced once more, and the similarity of the rhythm sequences may be output in a descending list.

In a preferred embodiment of the present invention, the DNA sequencer further includes a tune/rhythm equalizing unit which identifies which sequences both from the pitch sequence and from the rhythm sequence match together. The tune/the rhythm equalizing unit searches for the greatest possible match of both sequences by assuming the number of matches as a reference criterion. It would be optimum if all values match, and it would be sub-optimum, if n from m values match. As a result of this, a ranking is introduced once more, and the similarity of the tune/rhythm sequences may again be output in a descending list.

The DNA sequencer may be further arranged to either ignore and/or provide notes marked by the design rule checker 60 (FIG. 6) with a lower weighting for the result not to be unnecessarily falsified by any differing values.

What is claimed is:

1. Method for transferring a music signal into a note-based description, comprising the following steps:

generating a frequency-time representation of the music signal, the frequency-time presentation comprising coordinate tuples, one coordinate tuple including a frequency value and a time value, the time value indicating a time of occurrence of the assigned frequency value in the music signal;

calculating fit function as a function of time, a course of the fit function being determined by the coordinate tuples of the frequency-time representation;

determining at least two adjacent extreme values of the fit function;

time-segmenting the frequency-time representation on the basis of the determined extreme values, a segment being limited by two adjacent extreme values of the fit function, the time length of the segment indicating a time length of a note assigned to this segment; and determining a pitch of the note for the segment using coordinate tuples in the segment.

2. Method in accordance with claim 1, wherein the fit function is an analytical function, wherein, in the step of determining adjacent extreme values, a differentiation of the analytical function and a zero determination are carried out.

3. Method in accordance with claim 1, wherein the extreme values, which are determined in the step of determining, are minimum values of the fit function.

4. Method in accordance with claim 1, in which the fit function is a polynomial fit function of degree n, n being greater than 2.

5. Method in accordance with claim 1, wherein, in the step of segmenting, the time length of a note is determined from the time distance of two adjacent extreme values using a calibrating value, the calibrating value being the relationship of a specified time length of a tone to a distance between two extreme values, which was determined for the tone using the fit function.

6. Method in accordance with claim 4, in which the degree of the fit function is determined in advance for fit functions of varying degrees using specified tones of varying known lengths wherein the degree is used in the step of calculating, for which a specified matching between tone lengths determined by adjacent extreme values and known tone lengths results.

7. Method in accordance with claim 3, wherein in the step of time-segmenting it is only segmented at such a minimum value of the fit function, the frequency value of which is different from the frequency value of an adjacent maximum value by at least one minimum-maximum threshold value to eliminate fake minimum values.

8. Method in accordance with claim 1, wherein in the step of generating the following steps are carried out:

detecting the time occurrence of signal edges in the time signal;

determining a time distance between two selected detected signal edges and calculating a frequency value from the determined time distance and assigning the frequency value to an occurrence time of the frequency value in the music signal to obtain a coordinate tuple from the frequency value and the occurrence time for this frequency value.

9. Method in accordance with claim 8, wherein, in the step of detecting, a Hough transform is carried out.

10. Method in accordance with claim 1, wherein, in the step of generating, the frequency-time representation is filtered such that a pitch-contour strip band remains, and wherein, in the step of calculating fit function, only the coordinate tuples in the pitch-contour strip band are considered.

11. Method in accordance with claim 1, wherein the music signal is monophonic or polyphonic with a dominant monophonic share.

12. Method in accordance with claim 11, wherein the music signal is a note sequence sung by a person or performed by an instrument.

13. Method in accordance with claim 1, wherein, in the step of generating a frequency-time representation, a sample rate conversion to a predetermined sampled rate is carried out.

14. Method in accordance with claim 1, wherein, in the step of generating a frequency-time representation, a sound volume standardization is carried out by multiplication with a scaling factor, the scaling factor depending on a mean sound volume of a section and a predetermined maximum sound volume.

15. Method in accordance with claim 1, wherein, in the step of generating, an instrument-specific postprocessing of the frequency-time representation is carried out to obtain an instrument-specific frequency-time representation, and wherein the step of calculating the fit function is based on the instrument-specific frequency-time representation.

16. Method in accordance with claim 1, wherein, in the step of determining the pitch per segment, the mean value of the coordinate tuple in a segment or the median value of the coordinate tuple in the segment is used, the mean value or the median value in a segment indicating an absolute pitch value of the note for the segment.

17. Method in accordance with claim 16, wherein the step of determining the pitch comprises the step of determining tuning underlying the music signal using the absolute pitch values of notes for segments of the music signal.

18. Method in accordance with claim 17, wherein the step of determining the tuning comprises the following steps:

forming a multitude of frequency differences from the pitch values of the music signal to obtain a frequency difference coordinate system;

determining the absolute tuning underlying the music signal, using the frequency difference coordinate system and using a plurality of stored tuning coordinate systems by means of a compensational calculation.

19. Method in accordance with claim 18, wherein the step of determining the pitch comprises a step of quantizing the absolute pitch values on the basis of the absolute tuning and a reference standard tone, to obtain one note per segment.

20. Method in accordance with claim 1, wherein the step of segmenting comprises the following step:

transforming the time length of tones into standardized tone lengths by histogramming the time length and identifying a fundamental note length such that the time lengths of the tones may be indicated as integer multiples or integer fractions of the fundamental note length, and quantizing the time lengths of the tones to the next integer multiple or the next integer fraction to obtain a quantized note length.

21. Method in accordance with claim 20, wherein the step of segmenting further includes a step of determining a bar from the quantized note lengths by examining whether succeeding notes may be grouped to a bar scheme.

22. Method in accordance with claim 21, further comprising the following step:

examining a sequence of notes representing the music signal, each note being specified by a start, a length, and a pitch with respect to compositional rules, and marking a note, which is not compatible with the compositional rules.

23. Method for referencing a music signal in a database comprising a note-based description of a plurality of database music signals, comprising the following steps:

transferring the music signal into the note-based description, the step of transferring comprising the following steps:

generating a frequency-time representation of the music signal, the frequency-time representation comprising coordinate tuples, one coordinate tuple including a frequency value and a time value, the time value indicating a time of occurrence of the assigned frequency value in the music signal;

calculating a fit function as a function of time, a course of the fit function being being determined by the coordinate tuples of the frequency-time representation; determining at least two adjacent extreme values of the fit function;

time-segmenting the frequency-time representation on the basis of the determined extreme values, a segment being limited by two adjacent extreme values of the fit function, the time length of the segment indicating a time length of a note assigned to this segment; and determining a pitch of the note for the segment using coordinate tuples in the segment;

comparing the note-based description of the music signal with the note-based description of the plurality of database music signals in the database;

making a statement with respect to the music signal on the basis of the step of comparing.

24. Method in accordance with claim 23, wherein the note-based description for the database music signals has an MIDI-format, a tone start and a tone end being specified as a function of time, and wherein, prior to the step of comparing, the following steps are carried out:

forming differential values between two adjacent notes of the music signal to obtain a difference note sequence;

forming differential values between two adjacent notes of the note-based description of the database music signal, and wherein, in the step of comparing, the differential note sequence of the music signal is compared with the differential note sequence of a database music signal.

25. Method in accordance with claim 23, wherein the step of comparing is carried out using a DNA sequencing algorithm based on the Boyer-Moore algorithm.

26. Method in accordance with claim 23, wherein the step of making a statement comprises identifying the identity of the music signal and a database music signal, if the note-based description of the database music signal and the note-based description of the music signal are identical.

27. Method in accordance with claim 23, wherein the step of making a statement with respect to the music signal identifies a similarity between the music signal and a database music signal, unless all pitches or tone lengths of the music signal match with pitches or tone lengths of the database music signal.

28. Method in accordance with claim 23, wherein the note-based description comprises a rhythm description and wherein, in the step of comparing, a comparison of the rhythms of the music signal and of the database music signal is carried out.

29. Method in accordance with claim 23, wherein the note-based description comprises a pitch description and wherein, in the step of comparing, the pitches of the music signal are compared with the pitches of a database music signal.

30. Method in accordance with claim 25, wherein, in the step of comparing, insert, replace or delete operations are carried out with the note-based description of the music signal and wherein, in the step of making a statement, a similarity between the music signal and a database music signal is identified on the basis of the number of insert, replace or delete operations, which are required to achieve a greatest possible matching between the note-based description of the music signal and the note-based description of a database music signal.

31. Apparatus for transferring a music signal into a note-based description, comprising:

a generator for generating a frequency-time representation of the music signal, the frequency-time representation comprising coordinate tuples, a coordinate tuple including a frequency value and a time value, wherein the time value indicates a time of occurrence of the assigned frequency value in the music signal;

a calculator for calculating a fit function as a function of time, a course of the fit function being determined by the coordinate tuples of the frequency-time representation;

a processor for determining at least two adjacent extreme values of the fit function;

a time segmentor for time-segmenting the frequency-time representation on the basis of the determined extreme values, one segment being limited by two adjacent extreme values of the fit function, the time length of the segment indicating a time length of a note assigned to this segment; and another processor for determining a pitch of the note for the segment using coordinate tuples in the segment.

32. Apparatus for referencing a music signal in a database, comprising a note-based description of a plurality of database music signals, comprising:

means for transferring the music signal into a note-based description, the means for transferring being operative for:

generating a frequency-time representation of the music signal, the frequency-time representation comprising coordinate tuples, one coordinate tuple including a frequency value and a time value, the time value indicating a time of occurrence of the assigned frequency value in the music signal;

calculating a fit function as a function of time, a course of the fit function being determined by the coordinate tuples of the frequency-time representation;

determining at least two adjacent extreme values of the fit function;

time-segmenting the frequency-time representation on the basis of the determined extreme values, a segment being limited by two adjacent extreme values of the fit function, the time length of the segment indicating a time length of a note assigned to this segment; and determining a pitch of the note for the segment using coordinate tuples in the segment;

means for comparing the note-based description of the music signal with the note-based description of the plurality of database music signals in the data bank; and means for making a statement with respect to the music signal on the basis of the step of comparing.

* * * * *